US006439618B1

(12) United States Patent
Beeman et al.

(10) Patent No.: US 6,439,618 B1
(45) Date of Patent: Aug. 27, 2002

(54) COILED TUBING CONNECTOR

(75) Inventors: Robert S. Beeman, Bossier City, LA (US); Stephen P. Breaux, Bridgeport, WV (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/072,021

(22) Filed: May 4, 1998

(Under 37 CFR 1.47)

(51) Int. Cl.[7] ..... F16L 21/06
(52) U.S. Cl. ..... 285/323; 285/322; 166/242.2
(58) Field of Search ..... 285/322, 323, 285/243, 404; 166/242.2, 772.2

(56) References Cited

U.S. PATENT DOCUMENTS

| | | | | |
|---|---|---|---|---|
| 3,313,346 A | | 4/1967 | Cross | 166/5 |
| 3,559,905 A | | 2/1971 | Palynchuk | 242/86.5 |
| 3,724,567 A | | 4/1973 | Smitherman | 175/203 |
| 3,841,407 A | | 10/1974 | Bozeman | 166/315 |
| 4,194,579 A | | 3/1980 | Bailey et al. | 175/57 |
| 5,156,206 A | * | 10/1992 | Cox | 166/242 |
| 5,238,273 A | | 8/1993 | Laflin et al. | 285/119 |
| 5,285,850 A | * | 2/1994 | Bayh et al. | 166/321 |
| 5,291,956 A | | 3/1994 | Mueller et al. | 175/67 |
| 5,306,050 A | | 4/1994 | Laflin et al. | 285/119 |
| 5,348,088 A | | 9/1994 | Laflin et al. | 166/134 |
| 5,411,085 A | | 5/1995 | Moore et al. | 166/242 |
| 5,435,395 A | | 7/1995 | Connell | 166/384 |
| 5,452,923 A | | 9/1995 | Smith | 285/145 |
| 5,454,419 A | | 10/1995 | Vloedman | 166/277 |
| 5,503,230 A | | 4/1996 | Osborne et al. | 166/344 |
| 5,507,349 A | | 4/1996 | Wray et al. | 166/382 |
| 5,515,925 A | | 5/1996 | Boychuk | 166/379 |
| 5,524,937 A | | 6/1996 | Sides, III et al. | 285/133.1 |
| 5,738,173 A | | 4/1998 | Burge et al. | 166/385 |
| 5,762,142 A | | 6/1998 | Connell et al. | 166/325 |
| 5,775,433 A | | 7/1998 | Hammett et al. | 166/98 |
| 5,794,693 A | | 8/1998 | Wright et al. | 166/85.5 |
| 5,833,044 A | | 11/1998 | Coronado | 166/382 |
| 5,845,711 A | | 12/1998 | Connell et al. | 166/384 |

FOREIGN PATENT DOCUMENTS

| | | |
|---|---|---|
| DE | 1 182 169 | 11/1994 |
| GB | 2 287 731 A | 3/1994 |

OTHER PUBLICATIONS

Int'l Search Report, PCT/GB99/01181 PCT counterpart of this case.
The Coiled Tubing Boom, Petroleum Engineer, Apr. 1991, pp. 16–18, 20.
Coiled Tubing Services, Nowsco, 1996.
Versatech Oil Tools, 1997.
Underbalanced Drilling With Coiled Tubing, Canadian Fracmaster, Ltd., 1996.

* cited by examiner

*Primary Examiner*—Teri Pham Luu
(74) *Attorney, Agent, or Firm*—Moser, Sheridan & Patterson, L.L.P.

(57) ABSTRACT

A connector for coiled tubing has been invented which has a hollow body member having a top, a bottom, and a fluid flow channel therethrough from top to bottom, coiled tubing gripping apparatus connected to the hollow body, and a movable member movably connected to the bottom of the hollow body, the movable member having a top, a bottom, a top portion within the hollow body and a bottom portion projecting down beyond the bottom of the movable body, the movable member movable with respect to the hollow body and having a fluid flow bore therethrough from top to bottom. In one aspect the movable member is movable longitudinally with respect to the hollow body and/or laterally with respect to a longitudinal axis of the hollow body. In certain aspects the connector has selectively locking apparatus for selectively drivingly locking the hollow body to the movable member.

23 Claims, 2 Drawing Sheets

Fig. 1A
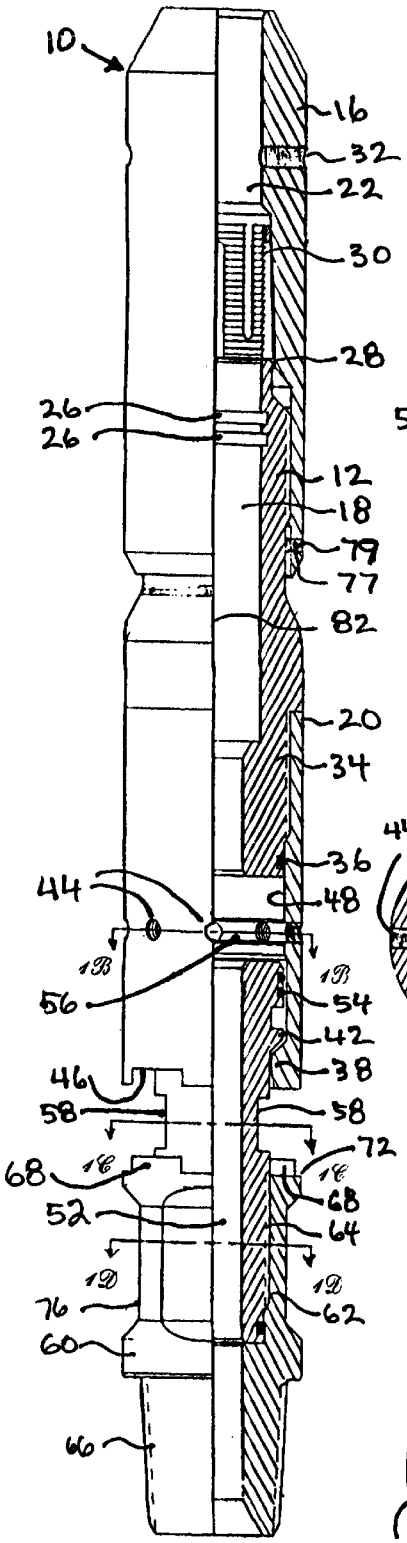
Fig. 1F
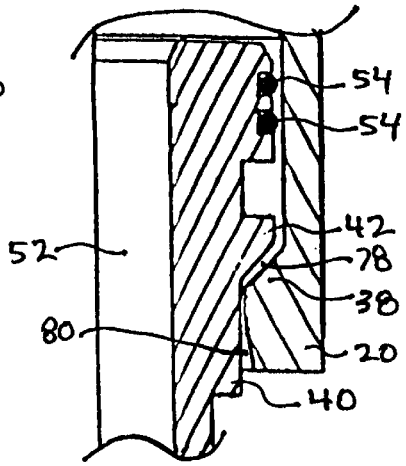
Fig. 1B
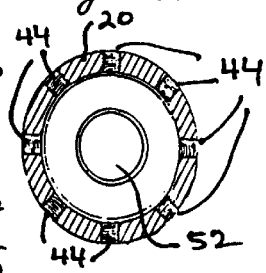
Fig. 1C
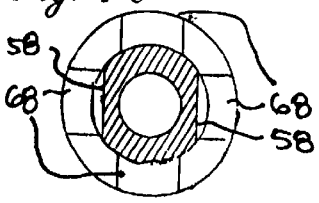
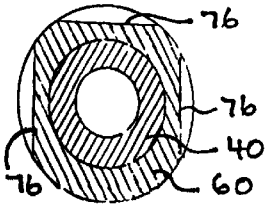
Fig. 1D
Fig. 1E
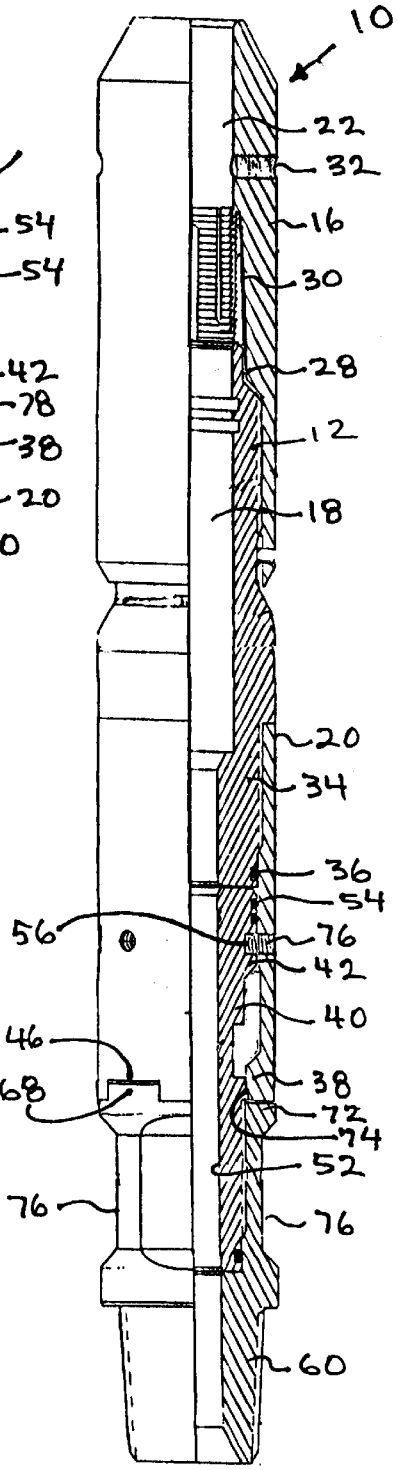

COILED TUBING CONNECTOR

BACKGROUND OF THE INVENTION

1. Field of the Invention

This invention is directed to wellbore coiled tubing connectors, to coiled tubing systems with such a connector, and to methods of their use.

2. Description of Related Art

Coiled tubing is used in many prior art systems instead of jointed pipe or jointed tubing wells, as drill pipe, production tubing, or casing, during well drilling or servicing operations, using either a drilling rig or a workover rig. Various kinds of downhole equipment tools, bottom hole assemblies, stabilizers, drill motors, and bits are attached to the end of coiled tubing.

Coiled tubing (e.g. of a relatively small diameter, e.g. approximately one inch) provides the maximum amount of tubing which can be mounted on a reel, but such small diameter coiled tubing: limits the flow of fluids; limits the amount of compression force that can be transmitted through the string of tubing in the well; limits the amount of tension that can be placed on the string of tubing; limits the amount of torque that the tubing can withstand; limits the type and weight of tools that may be used; and limits the length of tubing that may be used. Larger sizes of coiled tubing are also used in diameters ranging up to three and one-half inches and larger, but the use of such coiled tubing with small reels and associated handling apparatus may be difficult.

Typical prior art coiled tubing handling equipment includes a reel of coiled tubing mounted on a platform or vehicle, an injector to run the tubing into and out of the well, a gooseneck adjacent and/or permanently affixed to the injector for guiding the coiled tubing between the reel and the injector, a lifting device to support the injector and the gooseneck, a hydraulic power pack to provide power to the reel and the injector and to other hydraulic equipment, and surface equipment such as strippers and blow-out preventers to seal around the coiled tubing as it is run into and out of the well. A trailer or skid is used to transport the reel which may be of various sizes, depending upon the size of the coiled tubing to be reeled thereupon, and the length of coiled tubing to be carried. Repeated reeling and unreeling of coiled tubing on a reel increases tubing fatigue due to bending stresses.

Typically the injector is supported by the lifting device and the gooseneck includes a hydraulically powered boom or crane located at the rear of the coiled tubing trailer over the well. The hydraulically powered injector has drive chains with tubing grippers. The drive chains are hydraulically pressed against the tubing to grip the tubing and hydraulically driven sprockets drive the chains to run the tubing into or out of the well. The hydraulic power pack includes one or more engines driving one or more hydraulic pumps to power the reel, the crane, the injector, and other equipment. Other types of power equipment are also used.

A typical gooseneck has a curved guide member that receives tubing extending from the reel, uncoils the tubing from the reel, and guides the tubing between the drive chains of the injector. A plurality of rollers on the gooseneck support the tubing while the tubing is being guided by the gooseneck into the injector. Small radius bends found in certain goosenecks result in stress on the tubing.

In certain wellbore operations a relatively long tool, tools, or wellbore apparatuses must be connected to the end of the coiled tubing. Such an assembly is generally much stiffer than the coiled tubing and the positioning of such an assembly over a wellhead can result in stress on the coiled tubing which is greater than the typical bending and plastic deformation of the tubing during its passage through the gooseneck. Such stress can cause fatigue failure of the tubing.

There has long been a need for an efficient and effective coil tubing system which can include a relatively long, relatively stiff assembly at the end thereof whose use does not result in the application of severe stresses to the coiled tubing.

SUMMARY OF THE PRESENT INVENTION

The present invention, in certain embodiments, discloses and teaches a coiled tubing holder that has gripping apparatus (e.g. but not limited to as in internal slip and roll-on connectors) at one end for selectively gripping an end of coiled tubing and a connector movably connected to or interconnected with the gripping apparatus. In one aspect the movable connector has an end formed or machined so that it can not only rotate about a longitudinal axis of the holder, but can also move laterally away from the longitudinal axis, in one aspect tracing a conical or partial conical path at the end of the holder. This freedom of movement inhibits the transmission of stress to the coiled tubing.

In one aspect the movable connector is initially rotatable with respect to a housing member. The gripping apparatus is connected at the top of the housing member. The housing member has one or more lower clutch recesses and the movable member has one or more top drive lugs sized for selective receipt in the clutch recesses. The housing member has an inner space up into which the movable connector moves when housing member is moved downwardly about the movable connector. As the housing member moves down, the drive lug(s) move into the clutch recess(es) locking the two members together so that rotation of the gripping apparatus and housing member rotates the movable connector and whatever tools or apparatuses are connected to and beneath the movable connector. Alternatively such a selectable driving connection is achieved with mating spline members on the movable connector and on the housing, the splines of the movable connector moving up into and between corresponding spline members of the housing.

In certain embodiments the movable connector (or a lower member secured thereto) is provided with wrench flats and a threaded end for threaded engagement with a tool, device, or wellbore apparatus. A suitable wrench is used on the wrench flats to threadedly connect the movable connector or lower member to the tool, etc.

In certain embodiments the housing member has one or more holes therethrough through which a set screw or bolt is used to releasably hold the movable member to the housing member. A hole or groove may be provided in the housing member for receiving a portion of the set screw or bolt.

The movable member disclosed herein may be used in any tool or apparatus to absorb bending stress. The movable member disclosed herein may be used with any known tubing connector, including, but not limited to internal slip and roll-on connectors.

It is, therefore, an object of at least certain preferred embodiments of the present invention to provide:

New, useful, unique, efficient, nonobvious coiled tubing connectors, coiled tubing systems with such a connector, and methods of their use;

Such connectors, systems, and methods which permit a tool, system device, or apparatus to have freedom of movement thereby reducing stress on the coiled tubing to which an intermediate connector is connected; and Such connectors, systems and methods in which a movable connector initially moves with respect to a housing member but is selectively lockable thereto for rotation thereby and therewith.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1A is a side view of in cross-section of a coiled tubing connector according to the present invention.

FIG. 1B is a view along line 1B—1B of FIG. 1A.

FIG. 1C is a view along line 1C—1C of FIG. 1A.

FIG. 1D is a view along line 1D—1D of FIG. 1A.

FIG. 1E is a side view in cross-section of the connector of FIG. 1A.

FIG. 1F is an enlarged view of part of the connector of FIG. 1A.

DESCRIPTION OF EMBODIMENTS PREFERRED AT THE TIME OF FILING FOR THIS PATENT

Figure 2:
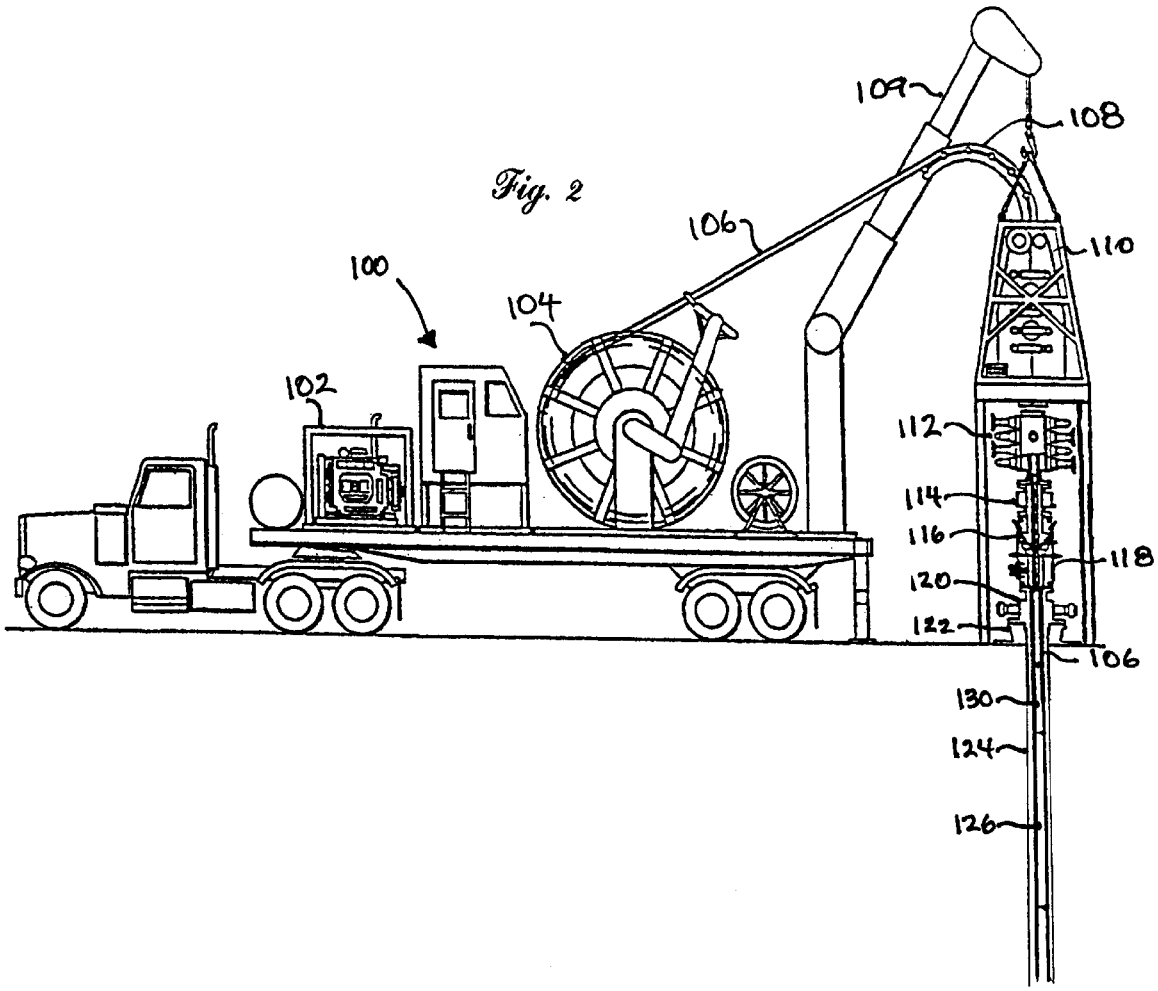
FIG. 2 is a schematic view of a coiled tubing system according to the present invention with a connector according to the present invention.

FIGS. 1A–1F show a coiled tubing connector 10 according to the present invention with an inner member 12 having a top threaded end 14 to which is threadedly connected a top sub 16. The inner member 12 has a fluid flow bore 18 therethrough from top to bottom and the top sub 16 has a fluid flow bore 22 therethrough from top to bottom.

O-ring seals (not shown) may be placed in corresponding inner grooves 26 of the inner member 12. An upper end 28 of the inner member 12 is movable to contact and force upwardly ratchet-toothed gripping apparatus 30 when the top sub 16 is tightened down on the inner member 12 (see FIG. 1E). A set screw hole 32 permits a set to screw onto the tubing to hold the tubing.

A housing 20 is threadedly connected to a lower end 34 of the inner member 12 and an O-ring 36 seals the inner member/ housing interface. A lower lip 38 of the housing 20 is positioned beneath a shoulder 42 of a movable member 40 and, initially, the lower lip 38 supports the movable member 40. A set screw 79 releasably extends through a set screw hole 77 to hold the top sub to the inner member 12. This screw is removed prior to setting of the gripping apparatus (see e.g. FIG. 1E) and may be reapplied thereafter. Set screws 76 may be introduced through a series of holes 44 through the housing 20. One or more clutch recesses 46 are provided at the end of the housing 20 to receive drive lugs 68. A bore 48 extends through the housing 20.

The movable member 40 has a fluid flow bore 52 therethrough from top to bottom in fluid communication with the bore 48 of the housing 20. Upper O-ring seals 54 seal the movable member/housing interface. A groove 56 around the movable member 40 receives an end of a set screw or screws extending through the holes 44. Wrench flats 58 are used to rotate the movable member 40, e.g. to threadedly connect it to another item or to a lower connection 60 and its drive lugs 68 are movable into the clutch recesses 46 of the housing 20.

The lower connection 60 has internal threads 62 for threadedly engaging external threads 64 of the movable member 40 and external threads 66 for threadedly engaging a wellbore tool, apparatus, device, system, assembly, etc. Wrench flats 76 facilitate rotation of the lower connection 60.

As shown in FIG. 1E, the housing 20 has been moved down around the movable member 40 and the drive lugs 68 of the lower connection 60 are lockingly positioned in the clutch recesses 46 of the housing 20. Rotation of coil tubing held in the gripping apparatus 30 top sub 16, inner member 12 and housing 20 rotates the movable member 40, lower connection 60 and any tool, etc. connected to the lower connection 60. Also, in this position the movable member 40 is no longer free to move away from the connector 10's longitudinal axis since the lip 38 of the housing 20 abuts a top end 72 of the lower connector 60 and a side 74 of the movable member 40. Also abutment of the upper end of the movable member 40 against an inner surface of the housing 20 and engagement of the set screws 76 prevents such lateral movement of the movable member 40.

FIG. 1F illustrates the mismatch between the movable member 40 and the housing 20. Space 78 between the lip 38 and the shoulders 42 and space 80 between the lip 38 and the outer surface of the movable member 40 permit the movable member 40 to be canted from the connector's longitudinal axis 82. The freedom of movement of the movable member 40, and hence of whatever is connected to the lower connection 60, both up and down and to a canted position, reduces stress on the coiled tubing held by the gripping apparatus 30.

FIG. 2 shows a coiled tubing system 100 according to the present invention which includes a mobile truck and power unit 102 with a coiled tubing reel 104 and coiled tubing 106, a guide arch or gooseneck 108, support 109, an injector head 110, a blow-out preventer 112, a wellhead or valve 114, a control line housing 116, a coiled tubing hanger 118, a tubing hanger 120, and a casing hanger 122. In a wellbore 124 a connector 130 (like the connector 10 described above or any connector disclosed herein according to the present invention) is connected to the coiled tubing at its top end and to a wellbore tool 126, etc. at its bottom end.

It is within the scope of this invention to substitute any known movable member which will permit some degree of bending to be used instead of the movable member 40. It is within the scope of this invention to use a movable member with drive lugs thereon, rather than on the lower connection. It is within the scope of this invention to use mating splines on the housing and movable member or on the housing and lower connection to achieve selective locking driving of the lower connection.

The present invention, in certain aspects, discloses a connector for coiled tubing having a hollow body member having a top, a bottom, and a fluid flow channel therethrough from top to bottom, coiled tubing gripping apparatus connected to the hollow body, and a movable member movably connected to the bottom of the hollow body, the movable member having a top, a bottom, a top portion within the hollow body and a bottom portion projecting down beyond the bottom of the movable body, the movable member movable with respect to the hollow body and having a fluid flow bore therethrough from top to bottom; such a connector wherein the movable member is movable longitudinally with respect to the hollow body; such a connector wherein the top portion of the movable member is movable within the hollow body; any such connector wherein the movable member is movable laterally in a direction away from a longitudinal axis of the hollow member; any such connector wherein the movable member has a shoulder, the hollow body has a lip disposed beneath the shoulder of the movable member, the lip loosely holding the movable member permitting movement of the movable member laterally away from a longitudinal axis of the hollow member; any such connector with wrench flats on the movable member; any such connector with a connection member connected to the movable member, in one aspect at a top end thereof, and the connection member suitable for connecting to another wellbore apparatus; any such connector with wrench flats on the connection member; any such connector with selectively locking apparatus for selectively drivingly locking the hollow body to the movable member; any such connector with lower locking apparatus on the lower connection, upper locking apparatus on the hollow body, and the lower locking apparatus engageable with the upper locking apparatus to permit rotation of the lower connection by rotating the hollow body; any such connector wherein the lower locking apparatus is at least one upwardly projecting drive lug, and the upper locking apparatus is at least one recess for receiving and holding the at least one drive lug; any such connector with coil tubing gripping apparatus connected to the hollow body; any such connector with coil tubing held by the coil tubing gripping apparatus; and any such connector with injection apparatus connected to the coil tubing for moving the coil tubing into a wellbore.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A connector for coiled tubing comprising:

a hollow body member having a top, a bottom, and a fluid flow channel therethrough from top to bottom;

coiled tubing gripping apparatus connected to the hollow body;

a movable member movably connected to the bottom of the hollow body, the movable member having a top, a bottom, a top portion within the hollow body and a bottom portion projecting down beyond the bottom of the hollow body, the movable member movable with respect to the hollow body and having a fluid flow bore therethrough from top to bottom, the movable member movable longitudinally with respect to the hollow body and laterally in a direction away from a longitudinal axis of the hollow member.

2. The connector of claim 1, wherein:

the movable member has a shoulder;

the hollow body has a lip disposed beneath the shoulder of the movable member; and the lip loosely holding the movable member permitting movement of the movable member laterally away from the longitudinal axis of the hollow member.

3. The connector of claim 2, further comprising:

wrench flats on the movable member.

4. The connector of claim 2, further comprising:

selectively locking apparatus for selectively drivingly locking the hollow body to the movable member.

5. The connector of claim 1, further comprising:

a connection member connected at a top end thereof to the movable member; and the connection member suitable for connecting to another wellbore apparatus.

6. The connector of claim 5, further comprising:

wrench flats on the connection member.

7. The connector of claim 5 further comprising:

lower locking apparatus on the connection member;

upper locking apparatus on the hollow body; and the lower locking apparatus engageable with the upper locking apparatus to selectively permit rotation of the connection member by rotating the hollow body.

8. The connector of claim 7, wherein:

the lower locking apparatus comprises at least one upwardly projecting drive lug; and the upper locking apparatus comprises at least one recess for receiving and holding the at least one drive lug.

9. The connector of claim 1, wherein:

the coiled tubing gripping apparatus is adapted for receiving the coiled tubing.

10. The connector of claim 9 further comprising:

injection apparatus connected to the coiled tubing for moving the coiled tubing into a wellbore.

11. A connector for coiled tubing comprising:

a hollow body member having a top, a bottom, and a fluid flow channel therethrough from top to bottom;

coiled tubing gripping apparatus connected to the hollow body;

a movable member movably connected to the bottom of the hollow body, the movable member having a top, a bottom, a top portion within the hollow body and a bottom portion projecting down beyond the bottom of the hollow body, the movable member movable with respect to the hollow body and having a fluid flow bore therethrough from top to bottom, the movable member movable longitudinally with respect to the hollow body and laterally in a direction away from a longitudinal axis of the hollow member;

a connection member connected at a top end thereof to the movable member;

the connection member suitable for connecting to another wellbore apparatus; and selectively locking apparatus for selectively drivingly locking the hollow body to the movable member.

12. The connector of claim 11, wherein:

the coiled tubing gripping apparatus is adapted for receiving the coiled tubing.

13. The connector of claim 12 further comprising:

injection apparatus connected to the coiled tubing for moving the coiled tubing into a wellbore.

14. A method for handling coiled tubing, the method comprising:

connecting the coil tubing to a connector, the connector comprising:

a hollow body member having a top, a bottom, and a fluid flow channel therethrough from top to bottom;

coiled tubing gripping apparatus connected to the hollow body; and a movable member movably connected to the bottom of the hollow body, the movable member having a top, a bottom, a top portion within the hollow body and a bottom portion projecting down beyond the bottom of the hollow body, the movable member movable with respect to the hollow body and having a fluid flow bore therethrough from top to bottom, the movable member movable longitudinally with respect to the hollow body and laterally in a direction away from a longitudinal axis of the hollow member; and gripping the coiled tubing with the coiled tubing gripping apparatus.

15. The method of claim 14 wherein a wellbore apparatus is connected to and below the movable member, the method further comprising:

moving the coiled tubing, connector, and wellbore apparatus into a wellbore.

16. A connector for coiled tubing, comprising:

a body member having a bore therethrough;

a coiled tubing gripping apparatus coupled to a first end of the body member;

a housing coupled to the body member; and a moveable member coupled to the housing and having a fluid flow bore therethrough, the movable member having a top, a bottom, a top portion within the housing and a bottom portion projecting below the bottom of the housing, the moveable member being moveable longitudinally with respect to the housing, and being moveable laterally in a direction away from a longitudinal axis of the housing.

17. The connector of claim 16, wherein the gripping apparatus is ratchet-toothed.

18. The connector of claim 16, further comprising:

a top sub having a shoulder and coupled to the coiled tubing gripping apparatus; and a lower sub coupled to the moveable member at a first end and a wellbore component on a second end.

19. The connector of claim 18, wherein the moveable member includes on an outer surface, a clutch recess that is mateable with a drive lug.

20. The connector of claim 19, wherein the moveable member includes a shoulder tilted from a lip on the housing.

21. The connector of claim 20, wherein the gripping apparatus is slideable along an inner surface of the top sub and contacts the shoulder of the top sub, thereby causing the gripping apparatus to grip a coiled tubing that can be received therein.

22. The connector of claim 21, further comprising selectively locking apparatus for selectively drivingly locking the housing to the moveable member.

23. The connector of claim 16, wherein the moveable member further comprises wrench flats on the outer surface.

* * * * *